US005873689A

United States Patent [19]

Mensour et al.

[11] Patent Number: 5,873,689

[45] Date of Patent: Feb. 23, 1999

[54] LOW TORQUE THREADED FASTENER AND MINE ROOF SUPPORT SYSTEM USING SUCH A FASTENER

[75] Inventors: Peter Mensour; Richard Tremblay; Mark Steklasa, all of Sudbury, Canada

[73] Assignee: Milad Mansour, Sudbury, Canada

[21] Appl. No.: 888,330

[22] Filed: Jul. 3, 1997

[51] Int. Cl.[6] ..... F16B 31/00; E21D 20/00

[52] U.S. Cl. ..... 411/3; 411/8; 411/429; 405/259.2

[58] Field of Search ..... 411/1–5, 8, 9, 411/429, 430; 405/259.2

[56] References Cited

U.S. PATENT DOCUMENTS

| | | | |
|---|---|---|---|
| 1,933,117 | 10/1933 | Markle | 411/429 |
| 4,618,291 | 10/1986 | Wright . | |
| 4,662,795 | 5/1987 | Clark | 411/8 |
| 5,282,698 | 2/1994 | Wright et al. . | |
| 5,352,065 | 10/1994 | Arnall | 411/3 |
| 5,352,066 | 10/1994 | Schaeffer et al. . | |

FOREIGN PATENT DOCUMENTS

| | | | |
|---|---|---|---|
| 497584 | 12/1950 | Belgium | 411/429 |
| 445374 | 12/1949 | Italy | 411/429 |
| 2132727 | 7/1984 | United Kingdom | 411/2 |

OTHER PUBLICATIONS

1995 Frazer & Jones Mine Roof Support Anchors Catalogue—p. 6.

*Primary Examiner*—Flemming Saether
*Attorney, Agent, or Firm*—Riches, McKenzie & Herbert

[57] ABSTRACT

A mine roof support system which includes a steel anchor rod and a threaded fastener. The rod has a threaded end portion, and which is adapted for positioning in a bore hole so that the threaded end portion projects outwardly from a rock face. The threaded fastener includes a body having a pair of opposing end portions and a bore which extends along its central axis. Internal threads complimentary to those on the rod are formed along part of the axial length of the bore, whereby the relative rotation of the fastener and rod moves the rod axially through the bore. A cap member is detachably coupled to one end portion of the fastener covering part of the bore. When coupled, the cap member acts as a positive stop which limits relative movement of the rod axially through the fastener bore, and which when detached allows the fastener to run freely along the threaded portion of the rod.

16 Claims, 5 Drawing Sheets

LOW TORQUE THREADED FASTENER AND MINE ROOF SUPPORT SYSTEM USING SUCH A FASTENER

SCOPE OF THE INVENTION

The present invention relates to a mine roof support system, and more particularly, a mine roof support system which includes a reinforcing rod or other threaded bolts having a threaded end engaged by a nut which is characterized by a release portion which when in place, contacts the end of the rod to prevent the nut from being threaded thereon any further, and which upon the application of a predetermined minimum torque force, releases to permit the nut to run freely onto the rod.

BACKGROUND OF THE INVENTION

In mine roof and wall support systems, a threaded reinforcing rod or rebar is embedded into the rock and a nut or threaded fastener is tightened against the rock face to consolidate forces in the rock and prevent or control ground movement. Typically, the rebar or reinforcing rod comprises a four to eight foot length of steel which is threaded at one end. The rebar is inserted into a bore hole drilled into the rock so that the threaded end projects outwardly beyond the rock face to permit the threaded coupling of the nut thereto.

U.S. Pat. No. 4,618,291 to Wright, which issued Oct. 21, 1986, discloses a preferred method of securing the rebar in a bore hole by the use of one or more resin cartridges which are inserted into the bore in advance of the rebar. After the resin cartridges are inserted, the rebar is pushed into the bore hole and driven through the resin cartridges causing the resin to mix and securely retain the rebar when set.

To enhance mixing of the resin, it is known to rotate the rebar about its longitudinal axis. One method of rotating the rebar involves positioning a cast steel dome nut over the threaded end of the rebar, and then rotating the nut with a power winch or socket. Conventional cast dome nuts typically are formed having a threaded socket which extends into a domed end portion characterized by an end opening. The domed end portion is formed with a thickness such that its engagement with the rebar prevents further movement of the dome nut onto the threaded end under initial torque forces, with the result that the rebar rotates together with the turning of the dome nut. As the resin sets, resistance to the rotation of the rebar increases. The result is that as the rotational torque forces applied to the nut exceed a critical minimum force, the domed end portion of the nut splits from the opening by the contact pressure forces of the rebar thereagainst, allowing the nut to be tightened along the rod against the rock face.

Conventional dome nuts suffer the disadvantage that the domed end configuration necessitates manufacture by expensive and labour intensive steel casting processes. The requirement of cast manufacturing further results in a dome nut which is typically of inferior quality steel as compared to the higher alloy steels used in machined steel nuts, making cast dome nuts more succeptable to mechanical failure.

The steel cast construction of dome nuts make their use in conventional mine support systems better adapted for use in coal mines or soft rock applications. In these environments, it is not unusual to tension a reinforcing rod using torques forces of 100 Ft. Lbs. or more, and to such an extent that the rock or coal seam actually compresses. This procedure may involve installing a reinforcing rod in a bore hole, allowing the resin to fully set, and then tightening the dome nut on the rod so that its threaded end is actually drawn out of the bore hole by its threaded engagement with the nut. Conventional mine roof support systems suffer the disadvantage that they are poorly suited for hard rock applications in which virtually no physical compression of the rock occurs. Some pneumatic drill equipment such as jacklegs and stoppers used in hard rock applications have difficulty producing sufficient torques to break the dome nut.

A further disadvantage with dome nuts is that, as a result of casting, it is difficult to produce nuts with consistent physical properties. In addition, to facilitate removal of the completed dome nut from a casting mould, cast dome nuts typically are manufactured with tapering opposing sides. Typically the opposing sides of the gripping portion of cast dome nuts taper inwardly towards each other in the direction of the domed end a distance of two or more millimetres. The inability to effectively produce cast dome nuts with substantially parallel sides adversely affects the gripping and twisting of the nuts with conventional wrench tools, and may lead to the nuts jamming within power winches and sockets which are used to drive the nuts onto the rebar.

Because of difficulties in casting dome nuts with their domed end portions, conventional dome nuts have a domed end which has a steel thickness of 2 mm or more. Cast dome nuts are therefore used primarily in high torque application where the torque has exceeded 100 Ft. Lbs. or more. In one attempt to manufacture a lower torque dome nut, U.S. Pat. No. 5,282,698 to Wright et al. discloses a cast dome nut in which the domed end portion is provided with a split-wall construction. Disadvantages with split dome nuts, however, exist in that in addition to difficulties in casting, split dome nuts are manufactured by casting a straight nut, and then mechanically crimping the curved end into a dome portion. As well as difficulties in ensuring consistent manufacture, mechanical crimping produces added stresses, with the result that the dome nuts do not evenly distort under consistent minimum torques. As a result, deformation of the cast domed end cannot be precisely controlled and may occur over a range of torque forces varying by 15 Ft. Lbs. or more.

The applicant has appreciated a preferred roof support system which provides for the installation of a rebar which when installed, projects two or more inches from the bore hole. With this configuration, the nut may be tightly secured against a reinforcing plate, or the rock itself, to prevent falls of ground. The projecting end portion of the rebar may thereafter be used to secure mesh screens, and/or hardware such as push-on plates used to secure screening, sill nuts and the like by the application of a second coupling nut in a second stage procedure. Conventional cast dome nuts are poorly suited for this purpose. In particular, by their operation the domed end portion splits and deforms by the action of its movement against the threaded end portion of the rebar. The contact forces between the domed end of conventional dome nuts against the external rod threads result in the scoring of the threads, effectively preventing the easy attachment of secondary components. Further, upon deformation, conventional dome nuts present a torn or split cast metal shard which extends axially from the edge of the nut 1 cm or more. Depending on the length of the rebar projecting from the bore, this may physically prevent the subsequent placement of a screen and/or hardware over the rebar to a position flush with the dome nut, and the use of a further nut used to attach the screen.

SUMMARY OF THE INVENTION

The present invention overcomes at least some of the disadvantages associated with prior art devices by providing a mine roof/wall support system comprising a threaded fastener for use in conjunction with an anchor member such as a threaded bar, rock bolt, reinforcing rod or rebar which is externally threaded at an end portion. The threaded fastener includes an axially extending bore characterized by internal threads at least partially along its length, and a releasable cap member extending across at least part of the bore. When the cap member is in place and the fastener is threaded onto the proximal end of the rod, the cap member acts to engage the endmost tip of the rod and prevent further movement of the fastener axially along the threaded end of the reinforcing rod. Upon a predetermined minimum axial pressure applied by the endmost tip of the reinforcing rod, the cap member releases substantially without contacting the external threads to permit the fastener to run axially substantially unhindered along the threaded end portion.

Another object of the invention is to provide a threaded fastener for use in mine roof/wall reinforcing systems which is inexpensive and easy to manufacture.

Another object of the invention is to provide a threaded fastener for coupling to rebar used in mine support systems which comprises a high alloy steel.

A further object of the invention is to provide a nut which when fully tightened on an installed reinforcing rod presents an outwardly flat planar surface which will not interfere with the placement of a mesh screen or subsequent fastener in juxtaposition thereagainst.

A further object of the invention is to provide a nut for use in a mine roof support system which may be easily manufactured to uniform tolerances and which may be used in low torque applications of preferably less than about 150 Ft. Lbs., and more preferably between about 40 and 50 Ft. Lbs.

Another object of the invention is to provide a threaded fastener for use with a reinforcing rod in a mine roof support system which, in assembly, will not score, scrape or otherwise adversely alter the threads of a tapped end of the reinforcing rod.

Another object of the invention is to provide a threaded fastener for threaded engagement with the threaded end of a reinforcing rod, and which includes a dome-shaped end cap or disc which is configured to completely detach from a remainder of the nut upon the application of a minimum predetermined torque.

Another object of the invention is to provide a threaded fastener for use in a mine roof support system which is characterized by a gripping portion having two or more opposing pairs of substantially parallel sides.

A further objective of the invention is to provide a mine roof/wall support system for use in hard rock applications which incorporates a threaded fastener having a threaded bore which is obstructed by a releasable member and which detaches from a remainder of the fastener upon the application of a predetermined minimum axial force.

The present invention provides a mine roof support system which includes a steel reinforcing anchor rod or rebar which is adapted for insertion axially into a bore hole extending into a cut rock face. A distal end of the reinforcing rod is secured in the bore hole by resin released from cartridges in a conventional manner. The proximal end of the reinforcing rod is provided with an externally threaded end portion. The reinforcing rod has a length and/or is positioned in the bore hole so that the threaded end portion projects outwardly from the rock face. A threaded fastener or nut having an internally threaded bore is provided for the threaded engagement with the threaded end of the rod. The nut or fastener is used to transmit rotational forces thereon to the rod causing it to rotate about its longitudinal axis and evenly mix any unset resin, and following the setting of the resin, the nut is tightened on the rod either directly against the rock face or against a bearing plate or other reinforcing structure positioned against the rock face. By tightening the nut against the rock face, the reinforcing rod is tensioned and the support system provides an active system to counter the expansion forces in the rock which may result in ground movement.

The threaded fastener includes a body having a pair of opposing end portions and a bore which extends along the central axis of the fastener from the first end portion to the second end portion. Internal threads are formed along part, and preferably, almost all of the axial length of the bore. The bore and internal threads of the fastener are configured for complimentary threaded engagement with the external threads on the threaded end of the reinforcing rod, whereby the rotation of the fastener and rod relative to each other results in the relative movement of the rod axially through the fastener bore by the engagement of the external threads of the rod with the internal threads of the fastener. A cap member is detachably coupled to one end portion of the fastener covering part, and preferably, substantially all of the bore. When coupled to the remainder of the fastener, the cap member acts as a positive stop which when contacted by the endmost tip of the reinforcing rod, limits relative movement of the rod axially through the fastener bore. The cap member may be coupled to the end portion either directly or indirectly using a number of releasable coupling mechanics including, for example, by one or more severable fingers or webs, a perforated seam or a seam of reduced thickness, or by direct welding or adhesives. The coupling mechanism is preferably selected to permit the cap member to be completely detached from a remainder of the threaded fastener upon the application of a predetermined minimum axial force. Preferably, the minimum axial force is applied by the engagement and axial movement of the endmost tip of the rod against the cap member on rotating the fastener with a predetermined minimum torque.

The precise configuration of the coupling mechanism used will directly relate to the minimum torque to be applied to the fastener to produce the detachment of the cap member. Where it is desired that the cap member release only under higher torque forces, the number and/or size and/or thickness of the coupling fingers, webs or the like is increased. Where the cap member is to release under lower torques, the number, size and/or thickness of the coupling members is decreased. The threaded fastener of the present invention is particularly suited for use where detachment of the cap member is desired with torque application of less than 100 Ft. Lbs., preferably 40 to 50 Ft. Lbs.

The cap member may comprise a flat or bent strip or disc, but most preferably is dome-shaped, extending convexly outwardly from the second end portion of the fastener body away from the first end portion. The releasable coupling members may join the peripheral edge of the dome-shaped member to the end portion of the nut body at locations spaced radially about the axis. Although not essential, for ease of manufacture the webs or fingers may extend from the peripheral edge of the dome-shaped cap member to a support ring which in turn is welded, glued or otherwise coupled to the end portion of the fastener body. With such a construction, the cap member, webs and ring may be stamped from a single piece of plastic, steel or other metal as an integral unit.

Preferably, the coupling mechanism is configured so that when the cap member detaches, the fastener is free to run onto the threaded end of the reinforcing rod with the external threads of the threaded end portion only engaged by the internal threads of the fastener.

Preferably, the releasable coupling members and/or any support ring are configured so that when the cap member is detached, the first and second end surfaces of the fastener member present substantially planar surfaces which are oriented generally normal to the axis. With this configuration, once the threaded fastener is secured and fully tightened, a mesh screen or a second anchor nut may be securely tightened on the threaded end of the reinforcing rod flush against the fastener.

Accordingly in one aspect, the present invention resides in a nut for tensioning an anchor member having an end portion with external threads which extend therealong proximate an endmost tip, said nut comprising, a body having first and second end portions, a bore having a central axis and extending from said first end portion to said second end portion, internal threads provided at least in part along the axial length of the bore, said bore having a complimentary size and shape to said end portion whereby the nut and anchor member are movable axially relative to each other by the relative rotational movement of the anchor end portion in the bore and the threaded engagement of said external threads with said internal threads, a support ring coupled to said second end portion, said support ring having an inner opening aligned with said bore, said inner opening having a diameter selected to permit substantially unhindered movement of said end portion axially therethrough, a releasable stop member detachably coupled to said support ring by release means, said stop member extending across at least part of said bore whereby when coupled to said support ring, said stop member prevents relative movement of said endmost tip axially therepast, and wherein said stop member is detachable from said support ring and body by the engagement of the endmost tip thereagainst upon rotating the anchor and nut relative to each other with a predetermined minimum torque.

In another aspect, the present invention resides in a threaded fastener for coupling with an externally threaded end portion of a rod, said threaded fastener comprising, a body having first and second ends, a bore having a central axis and extending from said first end to said second end, internal threads provided at least in part along the axial length of the bore, said bore having a complimentary size and shape to said end portion whereby said end portion of said rod may be moved axially along the bore by rotating the rod and the fastener relative to each other with the threaded end portion threadedly engaging said internal threads, a releasable dome-shaped member detachably coupled to said second end by release means when coupled to said second end, said dome-shaped member substantially covering said bore whereby said dome-shaped member limits further movement of said end portion of said rod axially therepast, said dome-shaped member being detachable from said second end by the engagement of an endmost portion of the rod thereagainst upon rotating the rod and fastener relative to each other with a predetermined minimum torque, and, when said dome-shaped member is detached from said second end, said first and second ends comprise substantially planar surfaces oriented normal to said axis.

In a further aspect, the present invention resides in a threaded fastener for coupling with an externally threaded end portion of a rod, said threaded fastener comprising, a body having first and second ends, and at least two pairs of parallel planar side surfaces extending substantially from said first end to said second end, a bore having a central axis and extending from said first end to said second end, internal threads provided at least in part along the axial length of the bore, said bore having a complimentary size and shape to said end portion whereby said end portion of said rod may be moved axially along the bore by rotating the rod and the fastener relative to each other with the threaded end portion threadedly engaging said internal threads, a releasable dome-shaped member detachably coupled to said second end by release means, when coupled to said second end said dome-shaped member substantially covering said bore whereby said dome-shaped member limits further movement of said end portion of said rod axially therepast, said dome-shaped member being detachable from said second end by the engagement of an endmost portion of the rod thereagainst upon rotating the rod and fastener relative to each other with a predetermined torque of about 50 Ft. Lbs. or less, and wherein said dome-shaped member has a radius of curvature selected so that the engagement of the endmost portion of the rod therewith occurs substantially without contact between the externally threaded end portion of the rod and the dome-shaped member.

BRIEF DESCRIPTION OF THE DRAWINGS

Reference may now be had to the following detailed description taken together with the accompanying drawings in which.

DETAIL DESCRIPTION OF THE PREFERRED EMBODIMENTS

Figure 1:
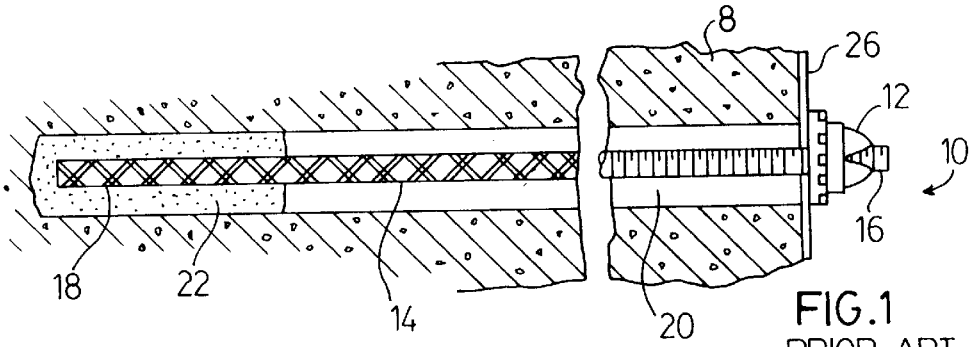
FIG.1 PRIOR ART
FIG. 1 shows a conventional low torque threaded fastener fully installed as part of a mine roof support system.

FIG. 1 shows a mine roof support assembly 10 used to reinforce a rock complex 8 and which comprises a conventional cast steel dome nut 12 and a steel reinforcing rod 14 or rebar. The reinforcing rod 14 includes an externally threaded proximal end portion 16 and a distal end portion 18. In the fully assembled configuration, the distal end portion 18 is inserted into a bore hole 20 formed in the rock complex 8 where it is secured by a mixed resin 22. The dome nut 12 is tightened over the part of the threaded proximal end portion 16 of the steel reinforcing rod 14 which projects outwardly beyond the bore hole 20.

Figure 6:
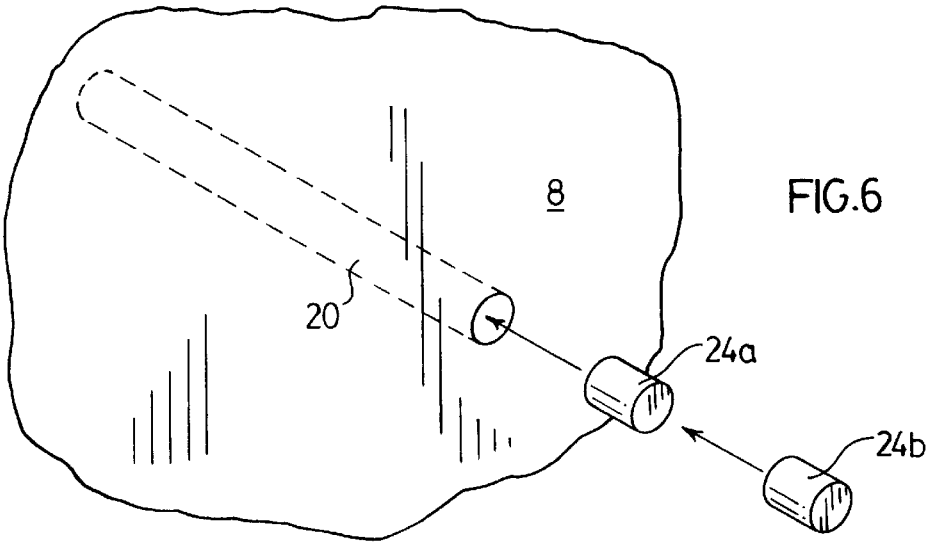
FIGS. 6 to 11 show a series of schematic and cross-sectional views of a rock structure, illustrating the installation of a mine roof support and reinforcement system in accordance with the present invention.
Figure 7:
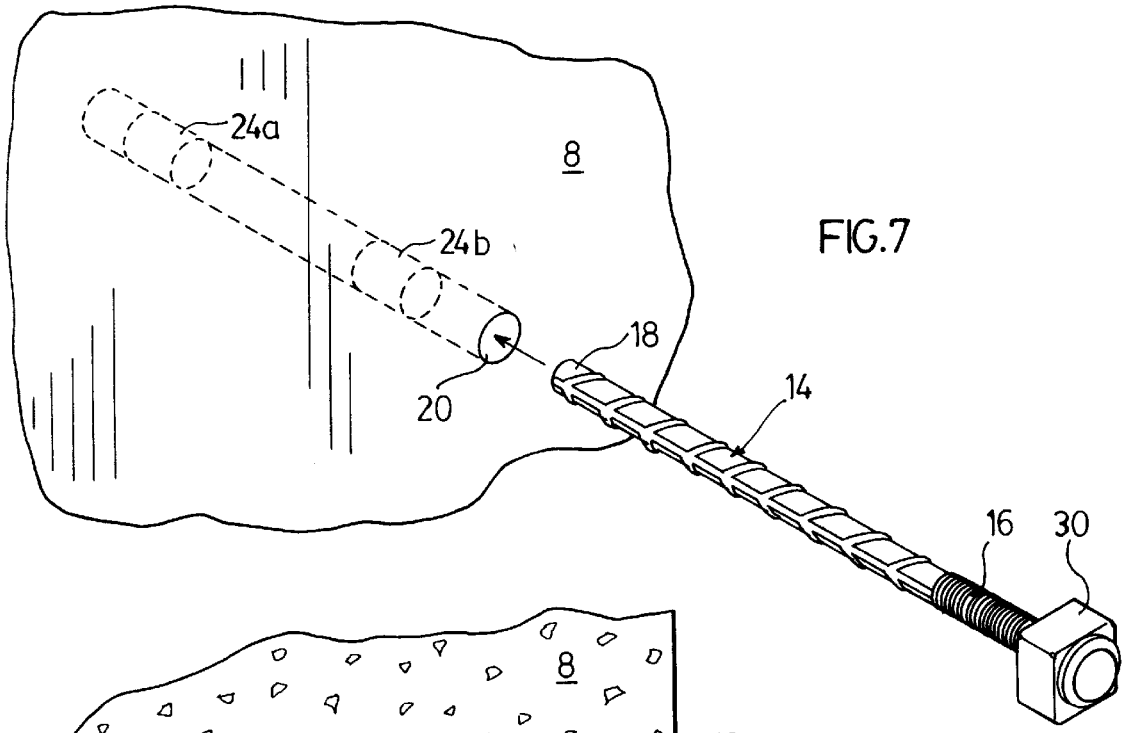

In installation, the bore hole 20 is drilled having a desired diameter and depth. A number of two-part resin cartridges 24*a*,24*b* (shown in FIG. 6) are then inserted into the hole 20 ahead of the distal end portion 18 of the steel rod 14. The distal end portion 18 of the rod 14 is next inserted into the bore hole 20 piercing the cartridges 23*a*,24*b* and mixing the resin 22. A steel reinforcing plate 26 is positioned over the rod 14, and the nut 12 is then threaded onto the proximal tip of the rod 14 and rotated, turning the rod 14 while the resin 22 remains unset. Once the resin 22 sets it encases and fixedly retains the distal end portion 18 of the rod 14 in the bore hole 20. The dome nut 12 is then driven in rotation on the threaded end portion 16 of the rod 14 by a socket drive or power wrench. When the nut 12 is rotated with a minimum required torque of typically 50 Ft. Lbs. or more, the threaded engagement of the proximal end portion 16 with the nut 12 causes the rock complex 8 to compress, and the rod 14 to be pulled outwardly from the bore hole 20 through the dome nut 12. As the rod 14 is drawn out further from the bore hole 20, the threaded end portion 18 is forced through the domed end of the nut 12, causing it to deform and split.

As is apparent from FIG. 1, the prior art system suffers the disadvantage in that on moving through the nut 12, the deformed sides of the dome nut 12 bear directly against the external threads on the proximal end portion 16. The contact forces which occur as the rod 14 forces the domed end of the nut 12 apart, often mar or distort the threads on the end portion 16, preventing the later removal of the nut 12 or the attachment of a second threaded fastener to the rod 14. Conventional dome nuts suffer a further disadvantage that significant torque forces are required to draw the rod 14 through the nut 12, making such fasteners poorly suited for low torque applications.

Figure 2:
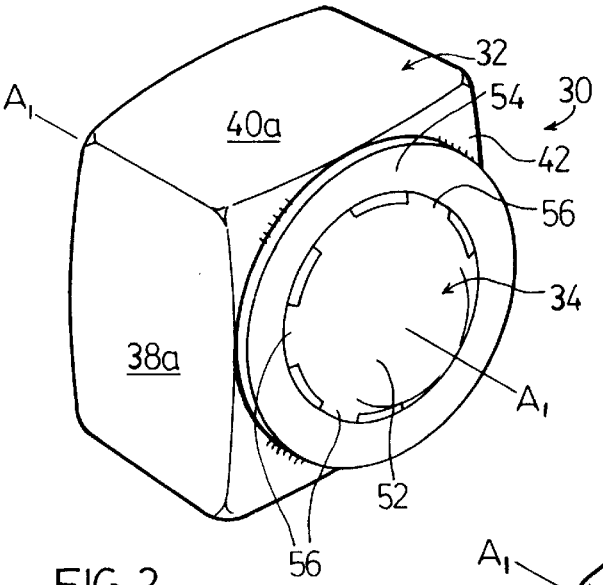
FIG. 2 shows a perspective view of a preferred threaded fastener in accordance with a first embodiment of the invention, prior to installation.
Figure 4:
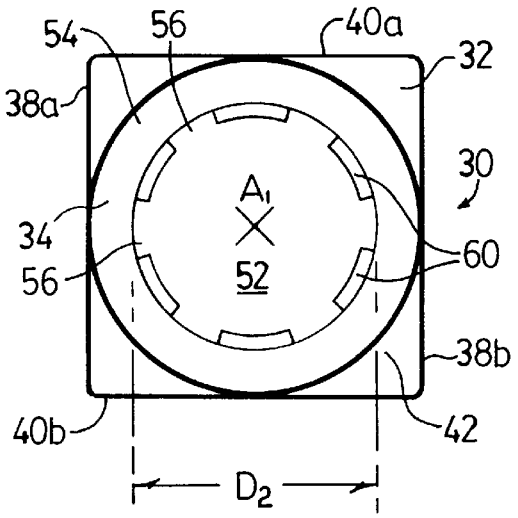
FIG. 4 shows a top view of the threaded fastener shown in FIG. 2.
Figure 5:
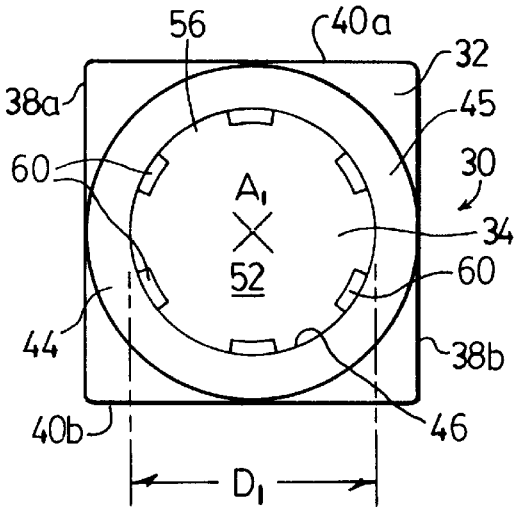
FIG. 5 shows a bottom view of the threaded fastener shown in FIG. 2.

FIGS. 2, 4 and 5 show best a threaded fastener 30 for use in a mine roof support assembly in accordance with a preferred embodiment of the invention, wherein like reference numerals are used to identify like components. For ease of manufacture, the fastener 30 is preferably formed of a two-part construction, consisting of a high alloy steel body 32 which may, for example, be formed in part by machining, and a cover 34.

The body 32 has generally a flattened square configuration with two opposing pairs of parallel side surfaces 38*a*, 38*b*, 40*a*,40*b* which are each equally spaced about a centre axis $A_1$ of the fastener 30, acting as the gripping portion of the fastener 30. The side surfaces 38*a*,38*b*, 40*a*,40*b* extend from a first end 42 to a second end 44 of the body 32. Although not essential, the edges along which the ends 42,44 intersect surfaces 38*a*,38*b*, 40*a*,40*b* are chamfered to ease the insertion and removal of the fastener 30 from any power socket or wrench. FIG. 5 shows best the chamfer of the edges along the end 44 as increasing in curvature radially outwardly from a flat annular surface portion 45. Although not shown, the first end 42 is formed having the mirror construction to second end 44.

Figure 3:
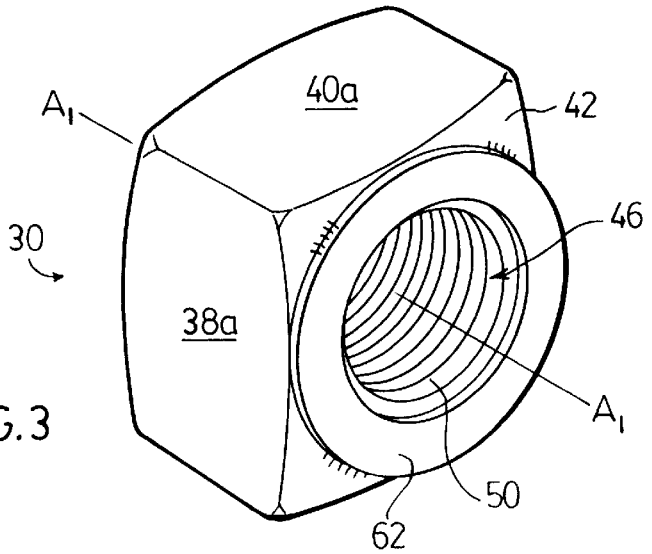
FIG. 3 shows a perspective view of the threaded fastener of FIG. 2 with the cap member detached.

FIG. 3 shows best the body 32 as being formed with a through-bore 46 which is centred on the centre axis $A_1$ of the fastener 30 extending through both ends 42,44 of the body 32. Internal threads 50 are provided along the axial length of the bore 46. It is to be appreciated that the bore 46 has a radial diameter $D_1$ (FIG. 5) and thread configuration selected so as to receive the proximal end portion 16 of the reinforcing rod 14 in complimentary threaded engagement therewith.

FIGS. 2 and 4 show best the cover 34 secured to the first end 42 of the body 32. The cover 34 includes a detachable dome-shaped cap member 52 and a circular support ring 54 which are each centred on the axis $A_1$, and which are joined by a plurality of webs 56. As seen best in FIG. 4, the external diameter of the ring 54 is selected so as not to extend radially outwardly from the axis $A_1$ beyond the side surfaces 38*a*, 38*b*, 40*a*,40*b*, where it may otherwise interfere with a drive socket or wrench used to turn the fastener 30. The internal diameter $D_2$ of the ring 54 is formed slightly larger than both the diameter $D_1$ of the bore 46 and that of the cap member 52. The cover 34 is secured to the body 32 by welding the ring 54 to the flat annular surface portion of the first end 42. As will be described, when the cap member 52 is removed, the diameter $D_2$ of the ring 54 permits the end portion 16 of the rod 14 to pass therethrough, substantially without contact between the ring 54 and external threads of the rod 14.

Figure 9:
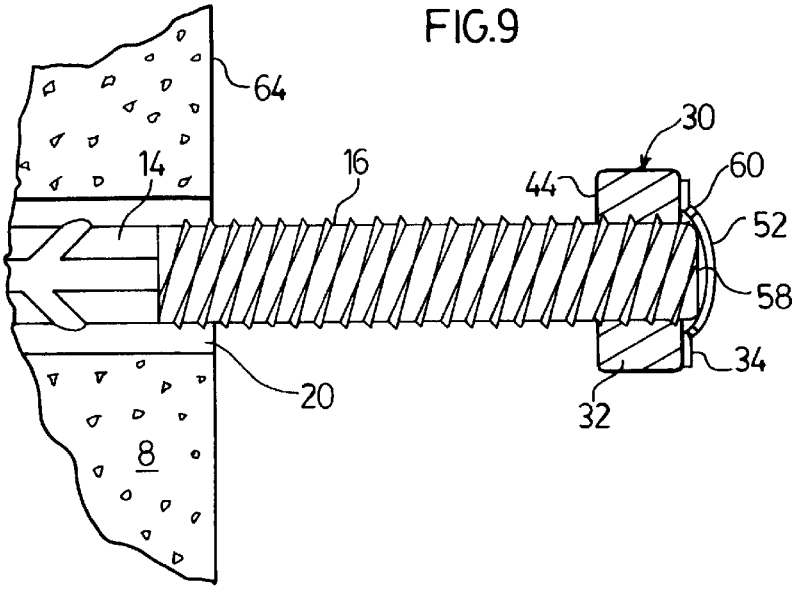
Figure 10:
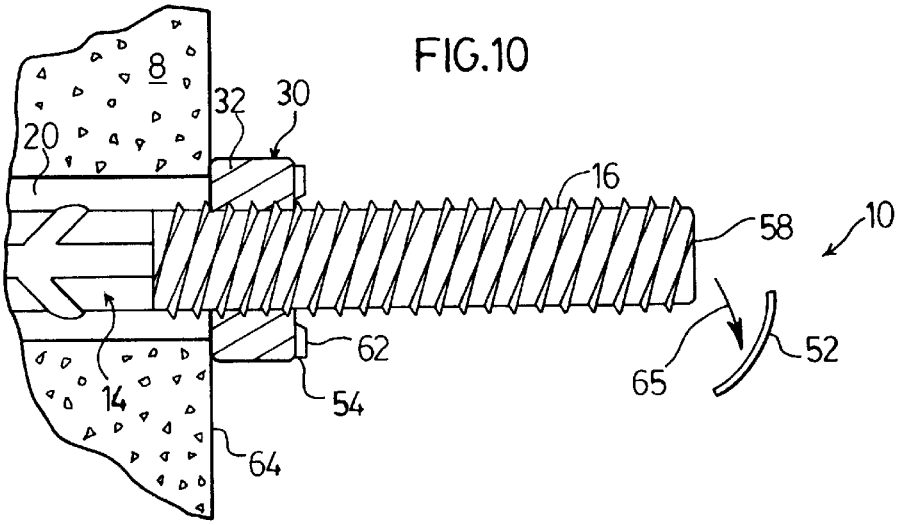

FIGS. 2 and 9 show the dome-shaped cap member 52 as curving concavely towards the axis $A_1$ in the direction away from the second end 44. The cap member 52 has a radius of curvature which is selected to permit the engagement of the proximal endmost tip 58 (FIG. 9) of the rod 14 thereagainst substantially without contact with the external threads of the proximal end portion 16. Most preferably, the cap member 52 is somewhat flattened and extends in the axial direction from the ring 54 a distance of about 4 mm or less. The cap member 52 is joined at its peripheral edge to the ring 54 by a plurality of, and more preferably, between four and eight webs 56. The webs 56 are spaced radially about the dome-shaped cap member 52 and are separated from each other by a series of spaced apertures 60 which provide points of weakness.

It is to be appreciated that while the cap member 52 remains coupled to the ring 54, the cap member 52 covers the bore 46 and blocks movement of the tip 58 of the rod 14 axially therepast. As the fastener 30 is screwed onto the proximal end portion 16 of the rod 14, the endmost tip 58 of the rod 16 moves axially through the bore 46 until it comes in contact against the cap member 52. Upon the endmost tip 58 of the rod 14 applying a predetermined minimum axial force to the dome-shaped cap member 52, as for example is produced by rotating the fastener 30 relative to the rod 14 with a predetermined minimum torque, the webs 56 deform and stretch and ultimately are severed, with the result that the dome-shaped cap 52 detaches completely from the ring 54. It is to be appreciated that the size and number of the webs 56 and apertures 60 are selected having regard to the desired predetermined minimum torque which is required to sever the webs and detach the cap member 52. Preferably, the webs 56 are configured so that the predetermined minimum torque is less than 50 Ft. Lbs., preferably between about 40 Ft. Lbs. and 50 Ft. Lbs., and most preferably less than 30 Ft. Lbs. The outer diameter of the cap member 52 and inner diameter $D_2$ of the ring 54 are selected so that when the cap member 52 is detached, the threaded end portion 16 of the rod 14 is free to move axially through the ring 54 with substantially little or no contact between the threads on the rod 16 and the ring 54.

FIG. 3 shows best the ring 54 as being flattened in the direction of the axis $A_1$. When the cap member 52 is detached, the ring 54 presents a substantially planar surface 62 which forms an outermost facing end of the fastener 30.

The surface 16 extends generally in a plain normal to the axis $A_1$ and does not interfere with the placement of a subsequent fastener, mounting plate or mesh screen 66 (FIG. 11) in juxtaposition therewith.

Figure 8:
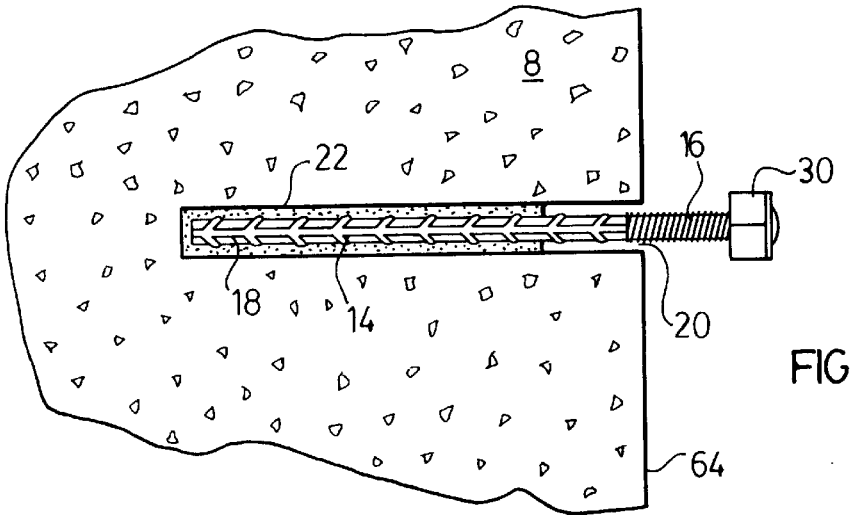

FIGS. 6 to 11 illustrate the installation of a mine roof/wall anchoring system 10 utilizing the threaded fastener 30 of FIG. 2. As shown best in FIGS. 6 and 7, a bore hole 20 is drilled to a depth of up to about 8 feet in the rock 8 which is to be reinforced. The reinforcing rod 14 is chosen having a length selected approximately two to six inches longer than the bore hole 20. The reinforcing rod 14 is provided with an externally threaded proximal end portion 16 characterized by external threads extending approximately two to six inches from the proximal endmost tip 58 (FIGS. 9 and 10) towards the distal end portion 18 of the rod. As with conventional systems, a plurality of cartridges (i.e. cartridges 23*a*,24*b*) are next inserted into the bore hole 20, and the distal end portion 18 of the rod 14 is inserted into the bore hole 20 following resin cartridges 23*a*,24*b*. The rod 14 is forced axially into the bore hole 20 so that the cartridges 23*a*,24*b* are crushed and the resin 22 is released by the engagement of the distal end portion 18. As shown in FIG. 8, with the rod 14 fully inserted into the bore hole 12, the threaded end portion 16 projects from the rock 8 a preferred distance of between approximately 1.5 to 6 inches.

The fastener 30 may be threaded over the endmost tip 58 of the rod 14 prior to its insertion into the bore hole 20. Optionally, the fastener 30 could be threaded onto the rod 14 after the insertion of the distal end portion 18 through the cartridges 23*a*,24*b*, and following the placement of a steel reinforcing plate (i.e. shown as 26 in FIG. 1) over the proximal end portion 16 of the rod 14 to position flush against the exposed rock surface 64. Following its positioning over endmost tip 58 of the rod 14 and the full insertion of the rod 14 into the bore hole 20, the fastener 30 is rotated about its axis $A_1$. The rotational forces on the fastener 30 and the engagement of the threads 50 with the threaded end portion 16 initially causes the fastener 30 to move axially onto the rod 14 until the endmost tip of the rod 14 is brought into bearing engagement with the cap member 52 in the manner shown in FIG. 9. A power driven socket or wrench (not shown) is positioned over the fastener 30 and the fastener 30 is rotated about its axis $A_1$. While the resin 22 remains unset, the dome-shaped cap 52 prevents further relative movement of the rod 14 axially through the bore 46. The result is that as the fastener 30 is rotated by the winch or socket, the rod 14 also rotates about its length to mix the liquid resin 22 in the bore hole 20.

Following mixing of the resin 22, the rotation of the fastener 30 is stopped and the resin 22 is permitted to harden. When hardened, the resin 22 secures the rod 14 against further rotation or movement in the bore hole 20. The power driven socket is then again activated to rotate the fastener 30 relative to the rod 14. As the fastener 30 is rotated relative to the rod 14, the threaded engagement of the internal threads 50 and threaded end portion 14 causes the endmost tip 58 to move axially against the dome-shaped cap 52. The fastener is rotated with a predetermined minimum torque of preferably between about 40 to 50 Ft. Lbs. to produce a sufficient axial force applied by the tip 58 to the cap member 52 to deform and sever the webs 56. The result being the complete detachment of the dome-shaped cap member 52 (i.e. arrow 65 in FIG. 10) from the ring 54 and body 32. With the cap 52 detached, the fastener 30 is free to move over the threaded end portion 16 without significant contact between the cover 34 and rod 14. The fastener 30 may be tightened to the position shown in FIG. 10 with its end 44 seated firmly against the rock surface 64. The threaded fastener 30 may thus be tightened to the desired torque to place the rod 14 under tension and provide an active support assembly 10.

It is to be appreciated that because the cap 52 completely detaches, bearing surfaces are not brought into engagement with the external threads on the end portion 16 of the rod 14. There is therefore no damage to the threaded end of the rod 14 and it remains possible to use the rod 14 for other anchoring purpose, or if desired, to later remove the fastener 30.

Figure 11:
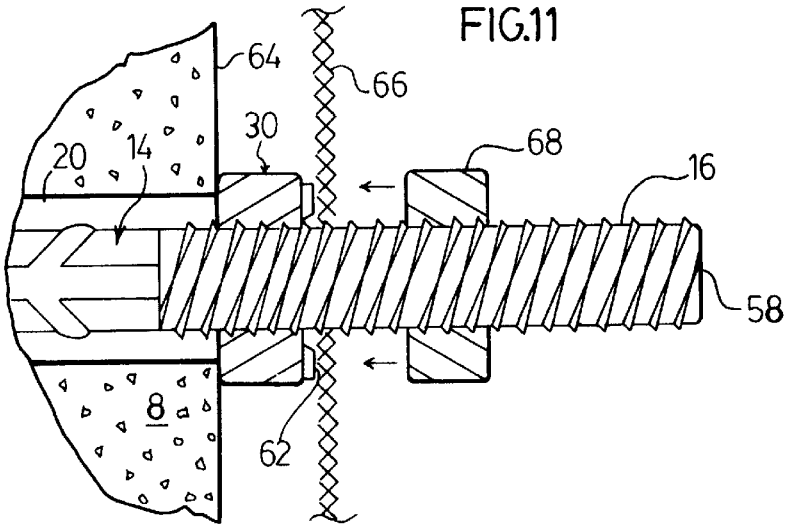

FIG. 11 shows a preferred mine roof/wall support assembly 10 wherein once the fastener 30 is fully tensioned in position abutting the rock surface 64, a safety screen 66 is positioned over the portion of the proximal end portion 16 which projects outwardly beyond the bore hole 20. A second threaded fastener or nut 68 (or other hardware) of a conventional design is thereafter threaded or installed onto the end portion 16. The nut 68 is tightened onto the rod 14, securing the mesh 66 in position against the fastener 30. It is to be appreciated that because the dome-shaped cap 52 completely detaches from the ring 54, the usable length of the threaded end portion 16 of the rod 14 is maximized, allowing the mesh 66 and nut 68 to be moved snugly against the surface 62.

The applicant has appreciated that the construction of the threaded fastener shown in FIG. 2 advantageously lends itself to simplified manufacture. The ring 54, cap member 52 and webs 56 may be formed from a single unitary sheet of steel, metal, or another construction, such as plastics or polymers, by stamping, moulding or the like. It is to be further appreciated that the threaded fastener 30 of the present invention may be easily modified to provide for the release of the cap member 52 upon different and extra minimum torques, simply by altering the extent and number of the apertures 60 and/or the web 56 configuration.

While preferred embodiment of the invention illustrates apertures 60 as the release mechanism, the invention is not so limited. If desired, the cap member 52 could be separated from the ring 54 through one or more metal webs having a reduced thickness to provide points of weakness which deform and tear.

Because the present invention avoids the difficulties associated with conventional cast steel dome nuts, the body 42 may be provided with substantially parallel side surfaces 38*a*,38*b*, 40*a*,40*b*. This reduces the likelihood that the fastener 30 may become wedged or jammed in a power socket, and reduces the possibility of slippage during tensioning.

Because the faster 30 of the present invention is not cast, the components of the fastener 30 may be made from high quality alloy steels which are more resistant to metal fatigue and failure. It is to be appreciated, however, that although less preferred, the present invention could be formed as a single cast metal construct, without departing from the scope of the invention.

The use of the circular ring 54 permits simplified construction and attachment of the cover 34. The invention is not, however, so limited. If desired, other oval or polygonal ring shapes and/or cap supporting structures are also possible and will now become apparent. Alternately, the fastener 30 may be easily formed by welding, gluing or otherwise attaching the cap 52 directly to the body 32.

Figure 12:
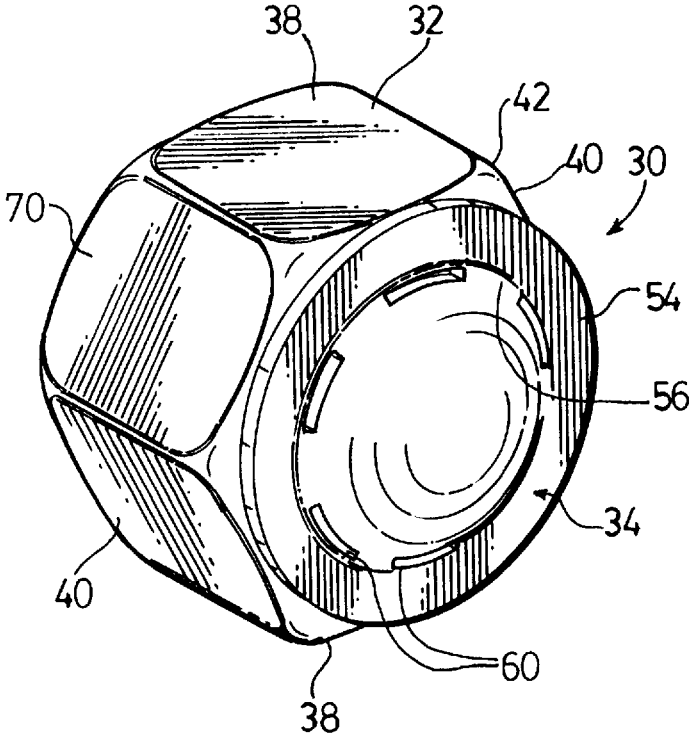
FIG. 12 shows a perspective view of a threaded fastener in accordance with a further embodiment of the invention.

While FIGS. 2 to 11 illustrate a four-sided fastener 30, it is to be appreciated that the present invention is equally suitable to fasteners and nuts of different configurations. FIG. 12 shows an alternate fastener 30 construction, wherein like reference numerals are used to identify like components. The fastener 30 of FIG. 12 is essentially of the same construction as that shown in FIG. 2 with the exception that the fastener has an overall hexagonal shape, having three pairs of parallel side surfaces 38,40,70 symmetrically spaced about its centre axis.

While the preferred embodiment of the invention discloses the use of the fastener 30 under low torque applications, the invention is not so limited. It is to be appreciated that by increasing the thickness of the cover member 34 and webs 56, the fastener 30 could be easily modified to provide for the release of the cap member 52 under high torque forces of 100 Ft. Lbs. or more, making the assembly 10 equally suited for use in soft rock applications.

Although the detailed description of the invention illustrates and describes various preferred embodiments, the invention is not so limited. Many modifications and variations will now occur to persons skilled in the art. For a definition of the invention, reference may be had to the appended claims.

We claim:

1. In combination an anchor member having an end portion with external threads which extend therealong proximate an endmost tip and a nut for tensioning said anchor member, said nut comprising, a body having first and second end portions, a bore having a central axis and extending from said first end portion to said second end portion, internal threads provided at least in part along the axial length of the bore, said bore having a complimentary size and shape to said end portion whereby the nut and anchor member are movable axially relative to each other by the relative rotational movement of the anchor end portion in the bore and the threaded engagement of said external threads with said internal threads, a support ring coupled to said second end portion, said support ring having an inner opening aligned with said bore, said inner opening having a diameter selected to permit substantially unhindered movement of said end portion axially therethrough, a releasable stop member detachably coupled to said support ring by release means, said stop member extending across at least part of said bore and comprising a dome-shaped member which curves convexly from said support-ring towards said axis away from both of the first and second end portions whereby when coupled to said support ring, said stop member locates externally from said bore to allow full engagement of said external threads with the internal threads of the nut while preventing relative movement of said endmost tip axially therepast, wherein said dome-shaped member has a radius of curvature selected so that the engagement of the endmost tip therewith occurs substantially in the absence of contact between the external threads and the dome-shaped member, and wherein said stop member is detachable from said support ring and body by the engagement of the endmost tip thereagainst upon rotating the anchor member and nut relative to each other with a predetermined minimum torque.

2. The combination as claimed in claim 1 wherein said release means comprises a plurality of metal webs, each having a thickness selected to sever and detach the stop member from the support ring when said predetermined minimum torque is less than about 50 Ft. Lbs.

3. The combination as claimed in claim 1 wherein said support ring is flattened in the axial direction whereby when said stop member is detached therefrom, said support ring provides a substantially planar end surface of said nut oriented substantially normal to said axis.

4. The combination as claimed in claim 3 wherein said support ring has an outer diameter selected smaller than a minimum radial extent of said second end portion.

5. The combination as claimed in claim 1 wherein said release means comprises a plurality of webs extending from said support ring to said dome-shaped member, said webs being spaced radially about said dome-shaped member.

6. The combination as claimed in claim 5 wherein said dome-shaped member, said support ring and said webs are integrally formed from a single metal blank.

7. The combination as claimed in claim 1 wherein said support ring is coupled to said second end portion by welding.

8. The combination as claimed in claim 1 further including two opposing pairs of parallel side surfaces extending substantially from said first end portion to said second end portion.

9. The combination as claimed in claim 1 further including three opposing pairs of parallel side surfaces extending substantially from said first end portion to said second end portion.

10. The combination as claimed in claim 1 wherein said dome-shaped member extends along said axis a distance of about 3 mm or less.

11. In combination a rod having an externally threaded end portion and a threaded fastener for coupling with the externally end portion of the rod, said threaded fastener comprising, a body having first and second ends, a bore having a central axis and extending from said first end to said second ends, internal threads provided at least in part along the axial length of the bore, said bore having a complimentary size and shape to said end portion whereby said end portion of said rod may be moved axially along the bore by rotating the rod and the fastener relative to each other with the threaded end portion threadedly engaging said internal threads, a releasable dome-shaped member detachably coupled to said second end by release means, said dome-shaped member curving convexly from the second end towards said axis away from both of the first and second ends and having a radius of curvature selected so that the engagement of an endmost portion of the rod therewith occurs substantially without contact between the externally threaded end portion of the rod and the dome-shaped portion, when coupled to said second end said dome-shaped member substantially covering said bore externally thereto to allow said externally threaded end to fully engage the internal threads and whereby said dome-shaped member limits further movement of said end portion of said rod axially therepast, said dome-shaped member being detachable from said second end by the engagement of the endmost portion of the rod thereagainst upon rotating the rod and fastener relative to each other with a predetermined minimum torque and, when said dome-shaped member is detached from said second end, said first and second ends comprise substantially planar surfaces oriented normal to said axis.

12. The combination as claimed in claim 11 wherein said release means comprises a plurality of web members connecting said dome-shaped member to said second end at locations spaced radially about said axis, each of said web members configured to permit detachment of the dome-shaped member when said predetermined minimum torque is less than 150 Ft. Lbs.

13. The combination as claimed in claim 11 wherein said second end includes a ring member having an inner opening centred on said axis, said inner opening having a diameter selected to permit unhindered movement of said externally threaded end portion therethrough.

14. The combination as claimed in claim 13 wherein said body comprises high alloy steel.

15. The combination as claimed in claim 11 wherein said dome-shaped member has an axial length of about 4 mm or less.

16. In combination a rod having an externally threaded end portion and a threaded fastener for coupling with the externally threaded end portion of the rod, said threaded fastener comprising, a body having first and second ends, and at least two pairs of substantially parallel planar side surfaces extending substantially from said first end to said second end, a bore having a central axis and extending from said first end to said second end, internal threads provided at least in part along the axial length of the bore, said bore having a complimentary size and shape to said end portion whereby said end portion of said rod maybe moved axially along the bore by rotating the rod and the fastener relative to each other with the threaded end portion threadedly engaging said internal threads, a releasable dome-shaped member detachably coupled to said second end by release means, when coupled to said second end said dome-shaped member substantially covering said bore externally thereto to allow said externally threaded end to substantially fully engage the internal threads and whereby said dome-shaped member limits further movement of said end portion of said rod axially therepast, said dome-shaped member being detachable from said second end by the engagement of an endmost portion of the rod thereagainst upon rotating the rod and fastener relative to each other with a predetermined torque of less than about 50 Ft. Lbs., and wherein said dome-shaped member curves convexly from the second end towards said axis away from both of the first and second ends and has a radius of curvature selected so that the engagement of the endmost portion of the rod therewith occurs substantially without contact between the externally threaded end portion of the rod and the dome-shaped member.

* * * * *